United States Patent [19]

Seaburg et al.

[11] 4,435,932

[45] Mar. 13, 1984

[54] ALTERNATING V-TRUSS ROOF SYSTEM AND METHOD OF ERECTION

[75] Inventors: Paul A. Seaburg; Richard W. Lautensleger, both of Middletown, Ohio

[73] Assignee: Armco Inc., Middletown, Ohio

[21] Appl. No.: 312,711

[22] Filed: Oct. 19, 1981

[51] Int. Cl.[3] ..... E04B 7/00

[52] U.S. Cl. ..... 52/263; 52/93; 52/289; 52/478; 52/643; 52/655; 52/694

[58] Field of Search ..... 52/262, 93, 639, 643, 52/648, 655, 694, 696, 289, 702, 478, 263

[56] References Cited

U.S. PATENT DOCUMENTS

| | | | |
|---|---|---|---|
| 2,624,430 | 1/1953 | Macomber | 52/694 |
| 3,019,861 | 2/1962 | Rasch et al. | 52/93 X |
| 3,111,207 | 11/1963 | Braddon | 52/655 |
| 3,367,081 | 2/1968 | Feltrin | 52/648 |
| 3,415,027 | 12/1968 | Snyder et al. | 52/655 X |
| 3,731,450 | 5/1973 | Du Chateau | 52/648 |
| 3,807,100 | 4/1974 | Kuss | 52/93 X |
| 3,893,276 | 7/1975 | Brown | 52/732 X |
| 3,978,635 | 9/1976 | Theault | 52/18 X |
| 4,282,619 | 8/1981 | Rooney | 52/648 X |
| 4,349,996 | 9/1982 | Lautensleger et al. | 52/363 X |

FOREIGN PATENT DOCUMENTS

| | | | |
|---|---|---|---|
| 230690 | 10/1960 | Australia | 52/694 |
| 52558 | 8/1974 | Australia | 52/648 |

*Primary Examiner*—Alfred C. Perham
*Assistant Examiner*—David J. Thomas
*Attorney, Agent, or Firm*—Frost & Jacobs

[57] ABSTRACT

A roof supporting structure and method of erecting such structure, the structure comprising a series of spaced apart rafters lying in parallel relation with a series of V-truss units extending between the rafters in parallel relation at spaced apart intervals to define rows of V-truss units supported at their opposite ends on the rafters, the V-truss units in a given row lying in alternating relation with respect to the V-truss units in the next adjacent row, the ends of the V-truss units in one row being interconnected with the adjoining ends of the V-truss units in the next adjacent row so that horizontal forces will be transmitted jointly by the V-truss units in adjacent rows. Modified V-truss units may be provided at the ends of alternate rows to further enhance the horizontal load supporting capability of the structure, the modified V-truss units additionally serving to mount the wall panels of a building utilizing the roof supporting structure. Girt members may be provided at the ends of the rows between the rows containing the modified V-truss units to provide continuity of support for the wall panels.

26 Claims, 11 Drawing Figures

ALTERNATING V-TRUSS ROOF SYSTEM AND METHOD OF ERECTION

This invention relates to roofing structures for buildings of the type having spaced apart rafters or beams which carry the truss members which support the roof.

BACKGROUND OF THE INVENTION

Various types of roof supporting structures have hitherto been proposed, including rafter-purlin systems which utilize essentially linear or one-way structural members and three-dimensional interlocking trusses which form a grid structure. One-way purlins or joists are laterally unstable and to overcome such instability it is necessary to install bracing members between the purlins or joists. This adds materially to the cost of the roof structure in that the bracing members must be individually installed on the job site after the one-way structural members have been put in place. In the case of three-dimensional interlocking trusses, or space grids, while such structures are highly efficient and capable of carrying loads both longitudinally and laterally, they are costly to manufacture and install and hence are not competitive with purlin or joist systems.

A number of the difficulties inherent in roofing systems of the foregoing types have been overcome by the integrated roofing system taught in copending application Ser. No. 143,261, filed Apr. 24, 1980, and entitled "Integrated Roof System", now U.S. Pat. No. 4,349,996. This system utilizes a series of V-trusses extending between the supporting rafters at spaced apart intervals, the V-trusses being arranged in aligned rows. Seats are provided to anchor the V-truss units to the rafters, and when installed the V-truss units are independent of each other and do not require interconnecting bracing. With this system, the V-truss units may be pre-fabricated and hoisted into position between the rafters with the opposite ends of their top chord members supported by the seats which are secured to the rafters. Since cross-bracing between adjoining V-trusses is not required, the cost of this system is materially reduced.

While the aligned V-truss system is self-bracing and has a high capacity for gravity and uplift loading, it must nonetheless rely on either the roof deck or additional diagonal bracing for lateral load (shear) resistance. In this connection, it will be understood that the roof deck is composed of interconnected roofing panels which are secured to the top chords of the V-trusses by means of concealed fasteners, such as those taught in U.S. Pat. No. 4,102,105, issued July 25, 1978. Such concealed fastener roof systems have limited shear capacity because the fasteners permit some slippage to occur between the roof panels and the supporting trusses or purlins.

The present invention is directed to a V-truss roofing system in which the rows of trusses are arranged in alternating relation so as to develop shear load capability by transferring horizontal forces through the alternating V-trusses to the walls of the structure. The structure thus has the capability of transferring a wind load acting on a given wall of the structure to adjoining walls.

SUMMARY OF THE INVENTION

In accordance with the invention, the rows of V-trusses are arranged in alternating relation to each other rather than being aligned end to end between the supporting rafters or beams. Thus, where rows of the trusses are supported at their opposite ends on rafters, the trusses in the second row will lie in alternating relation to the trusses in the first and third rows, the trusses being staggered so that the top right-hand chords in the first row of trusses will be aligned with the top left-hand chords of the trusses in the second row, and vice versa. The abutting chords are interconnected by common seats which mount the trusses on the rafters. This arrangement provides for the transfer of horizontal forces from the chord in one row directly to the chord in the adjacent row. In addition, forces are transfered from top chord to top chord of an individual V-Truss through its web members and bottom chord tie. Consequently two bays of alternating V-trusses work in concert to transfer forces to the walls of the building and hence to the foundation through the wall support system.

By alternating the rows of V-trusses relative to each other, the need for additional bracing is eliminated and highly effective shear resistance is developed by the same number of V-truss units required to support vertical loads applied to the roof. Consequently, the cost of fabricating and installing the roof system is essentially the same as that for a system wherein the V-trusses are aligned end to end, yet by reason of the alternating arrangement of the V-trusses, the trusses are inherently capable of transferring wind or seismic loads (horizontal forces in a given direction) to load support systems such as provided by the adjoining walls of the structure, thereby solving a structural problem with roof systems having low diaphragm strength without the necessity for extensive cross-bracing or the necessity to utilize costly space grids.

In addition to the basic concept of utilizing alternating V-truss members, the invention also contemplates the provision of modified V-truss members extending along the opposite sides of the structure in parallel relation to the roof supporting V-trusses, the modified trusses being inclined relative to the roof supporting trusses and acting to transfer horizontal forces vertically downwardly to lower points on the supporting columns. The inclined truss members lie in alternating relation with respect to the roof supporting trusses and extend between the supporting frame lines, one side of the inclined truss attaching to the rafter and the other side attaching to the column. When desirable, the inclined truss members are supported by intermediate wind columns to which the horizontal forces may be transferred.

An improved truss seat is provided which facilitates on-site attachment of the V-trusses to the supporting rafters, as well as serving to transmit the shear forces from one V-truss to another. The configuration of the seats is such that the top chords of the V-trusses may be easily bolted to the seats, thereby facilitating assembly.

Basically, the V-trusses each comprises an elongated structural unit which is V-shaped in cross-section, having a spaced apart pair of top chords and at least one bottom chord forming the apex of the "V", the top chords and the bottom chord being interconnected by diagonally disposed web members, with laterally disposed tie members extending between the upper chords. In a preferred embodiment, the V-trusses are composed of two half-truss sections each having a top chord and a bottom chord interconnected by diagonally disposed web members. The half-truss sections may be shop fabricated and shipped to the job site where pairs of the half-truss sections may be assembled on the ground prior to being positioned on the rafters, the sections being assembled by angularly disposing them relative to each other with the facing surfaces of their bottom chords juxtaposed and secured together. The top chords are interconnected by tie members which preferably coincide with the upper ends of the diagonally disposed web members, thereby forming the complete V-truss units. After the V-truss units are assembled and hoisted into position on the supporting rafters, the roof structure is completed by the attachment of the roof forming panels, which are preferably prefabricated and adapted to be secured to the top chords of the V-trusses by means of fasteners.

The modified V-trusses are of similar configuration, although their chords are modified to accommodate their inclined positions along the opposite sides of the structure, and their cross-sectional dimensions may differ from those of the principal roof supporting trusses.

The present invention thus provides an improved integrated roofing structure characterized by the absence of bracing between the roof-supporting truss members, the arrangement of the V-trusses being such that while the individual trusses are essentially one-way members, they collectively provide a mechanism for transferring horizontal loads to the supporting walls.

BRIEF DESCRIPTION OF THE DRAWINGS

FIG. 7 is an enlarged fragmentary elevational view illustrating a seat member and the manner in which the modified inclined V-truss member is mounted on the seat.

FIG. 9 is an enlarged fragmentary elevational view illustrating the manner in which the roof supporting V-truss units are secured to a seat.

DETAILED DESCRIPTION

Figure 3:
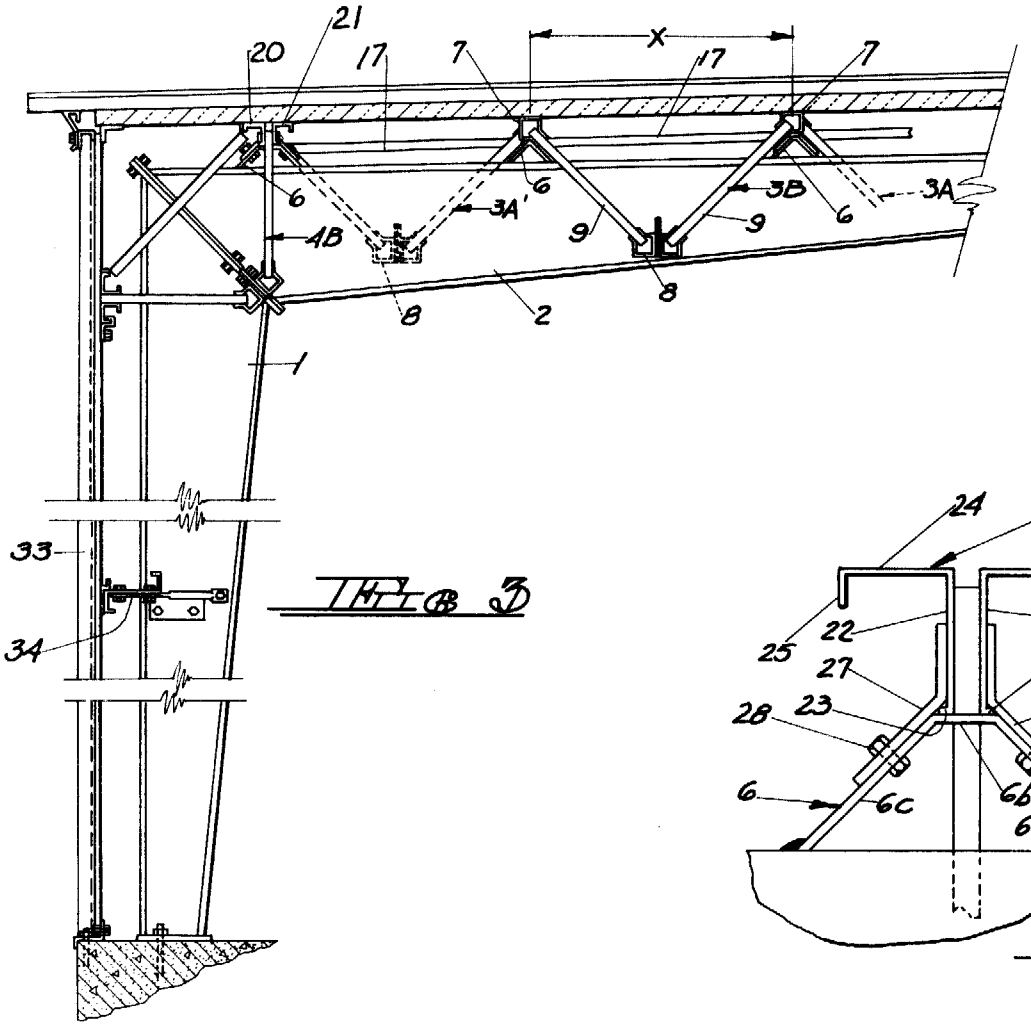
FIG. 3 is an enlarged elevational view of the load supporting roof structure taken along the lines 3—3 of FIG. 2.
Figure 2:
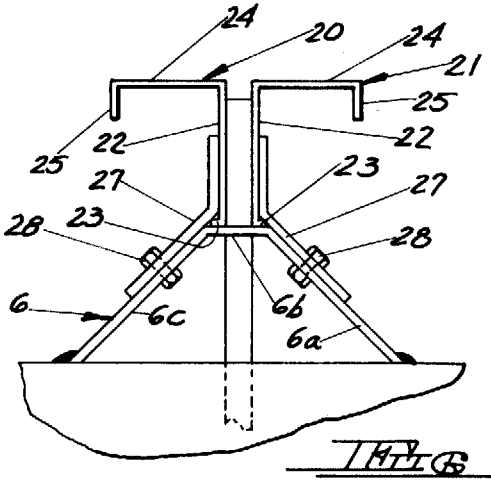

Referring first to FIG. 3 of the drawings, the basic building structure comprises spaced apart vertical columns 1 which support the beams or rafters 2 which in the embodiment illustrated are of I-shape cross-section and supported on the columns in conventional fashion. The columns normally will be of I-shaped configuration, although other known forms of columns and beams may be employed. It will be understood that the number of columns and beams, as well as the length of the trusses, will depend upon the size of the structure. The beams will be spaced apart so that rows of V-truss units 3 may extend therebetween, the truss units being supported at their opposite ends by the beams 2.

Figure 1:
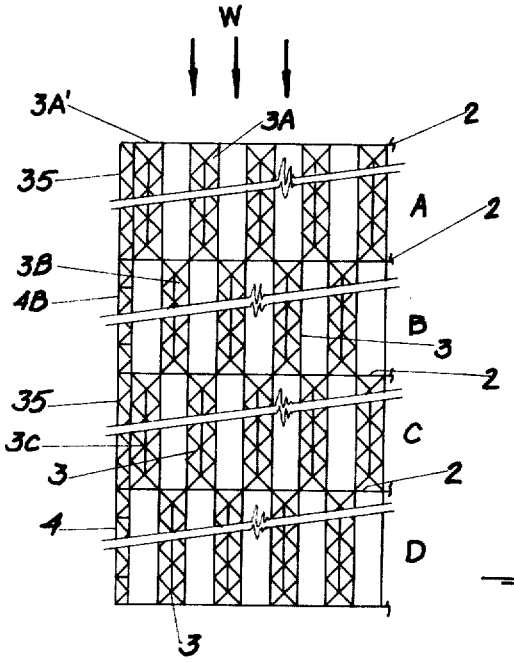
FIG. 1 is a diagrammatic plan view illustrating an alternating truss load supporting roof structure in accordance with the invention.
Figure 2:
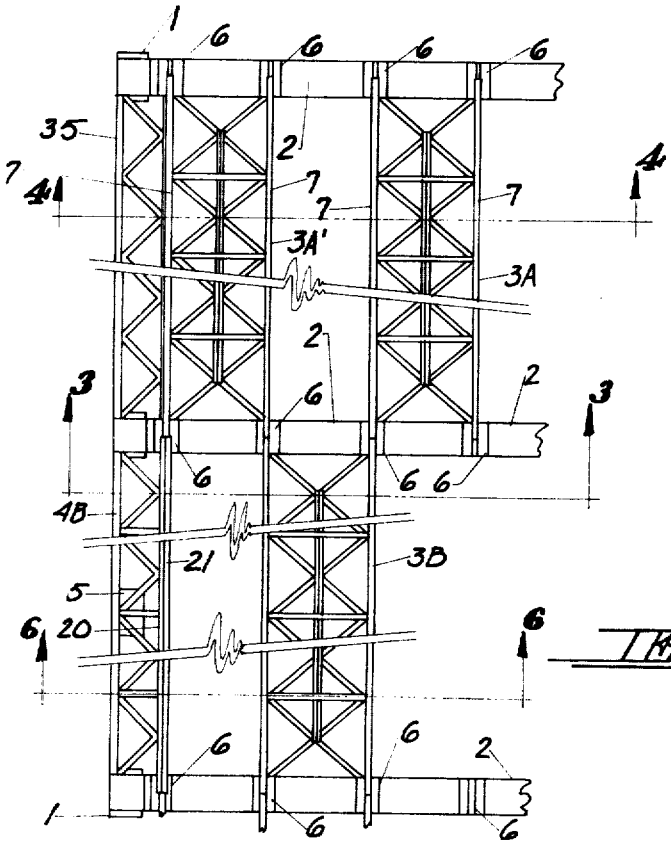
FIG. 2 is an enlarged fragmentary plan view illustrating additional details of the V-truss units and the manner in which they are interconnected.

In accordance with the invention, and as best seen in FIG. 1, the V-truss units 3 are alternated in adjacent bays or rows rather than being aligned end to end. Thus, the trusses in row A are alternated relative to the trusses in row B. At least two such alternating rows are required to provide a horizontal force support system. However, as shown in FIG. 1, all rows throughout the building length may be arranged in this alternating pattern. Thus the trusses in row A are alternated relative to the trusses in row B, and similarly the trusses in row B are alternated relative to the trusses in row C, the arrangement being such that the trusses in rows A and C are in axial alignment, as are the trusses in rows B and D. Considering first the case of two adjoining rows of alternating trusses, such as the rows A and B, these rows acting together will support horizontal forces, such as a wind load indicated by the arrows W. The forces applied to the ends of the trusses in row A are transmitted laterally in the direction of the adjacent sidewall through the web system and bottom chords of each individual V-truss unit. Thus truss 3A, for example, is capable of transferring forces across its width toward the adjacent wall. These forces will be transferred to row B acting on truss 3B and hence across its width toward the wall and then back to truss 3A' in row A so as to ultimately reach bracing or other means of horizontal force support at the wall. For additional rows of alternating trusses the mechanism for supporting applied forces is similar except that interaction between all of the rows of trusses occurs. The transfer of the horizontal forces is through the V-trusses themselves without the necessity for additional bracing within each row.

The invention also contemplates the use of modified V-trusses 4 extending along the opposite sides of the structures in alternating relation with respect to the adjacent roof supporting trusses 3. Thus, for example, the modified V-truss 4B lies in alternating relation to the adjoining roof supporting V-trusses 3A' and 3C. The modified trusses are supported at their opposite ends on the adjoining beams 2. As will be evident from FIGS. 3 and 6, the modified trusses 4 are inclined with respect to the roof supporting trusses 3. The modified trusses serve to transfer horizontal forces vertically downward parallel to the wall and act both as horizontal supporting members for the wall and vertical supporting members for the roof. The modified V-trusses may also support the top of intermediate wind support columns 5 lying between the columns 1.

As seen in FIG. 3, in any given row the trusses 3 are spaced apart by the distance X which is equal to the width of the trusses measured at their top chords. Thus the lateral spacing between adjacent trusses in a given row is equal to the width of the trusses in the next adjacent row, as indicated by dotted lines in FIG. 3. The trusses are interconnected at their opposite ends by means of the seats 6 which project upwardly from the beams 2 and are arranged to support the V-trusses 3, the top chords 7 of the V-trusses being effectively interconnected through their common seats. In similar fashion, the outermost V-trusses 3 extending along the opposite sides of the structure are connected to the modified V-trusses 4 through their common seats 6.

Each of the V-trusses 3 is composed of top chords 7 and at least one bottom chord 8, the top and bottom chords being interconnected by diagonally disposed web members 9. In an exemplary embodiment the trusses have a width of 5 feet at the top chords and a length of 40 feet, with the diagonal web members engaging the chords at intervals of 5 feet. In a preferred truss construction illustrated in FIG. 5, each V-truss unit is composed of a pair of half-truss sections, indicated generally at 10 and 11, each section comprising a top chord 7 and a bottom chord 8 interconnected by web members 9. The chords 7 and 8 are essentially square in cross-section, as by being roll-formed to the shape illustrated, the chords each having spaced apart flanges 12 and 13 projecting outwardly from a corner edge of the chord to define a longitudinal slot of a size to receive the ends of the web members 9. Such arrangement facilitates shop fabrication of the half-truss sections, the chord and web members being laid out in a jig and welded together to form essentially planar half-truss sections in which the faces or sides of the chords are diagonally disposed with respect to the plane of the truss sections. Web members 9 may be formed from standard square or rectangular tubing, or from open sections, and will extend inwardly into the hollow interiors of the chords, being welded to the flanges 12 and 13. The web members may be cut to the desired lengths, or a plurality of adjoining web members may be formed from a single length of stock configured to provide an integral series of diagonally disposed web members. The prefabricated half-truss sections may be stacked one upon the other and shipped to the job site for assembly into V-truss units prior to installation on the rafters.

Figures 5, 8:
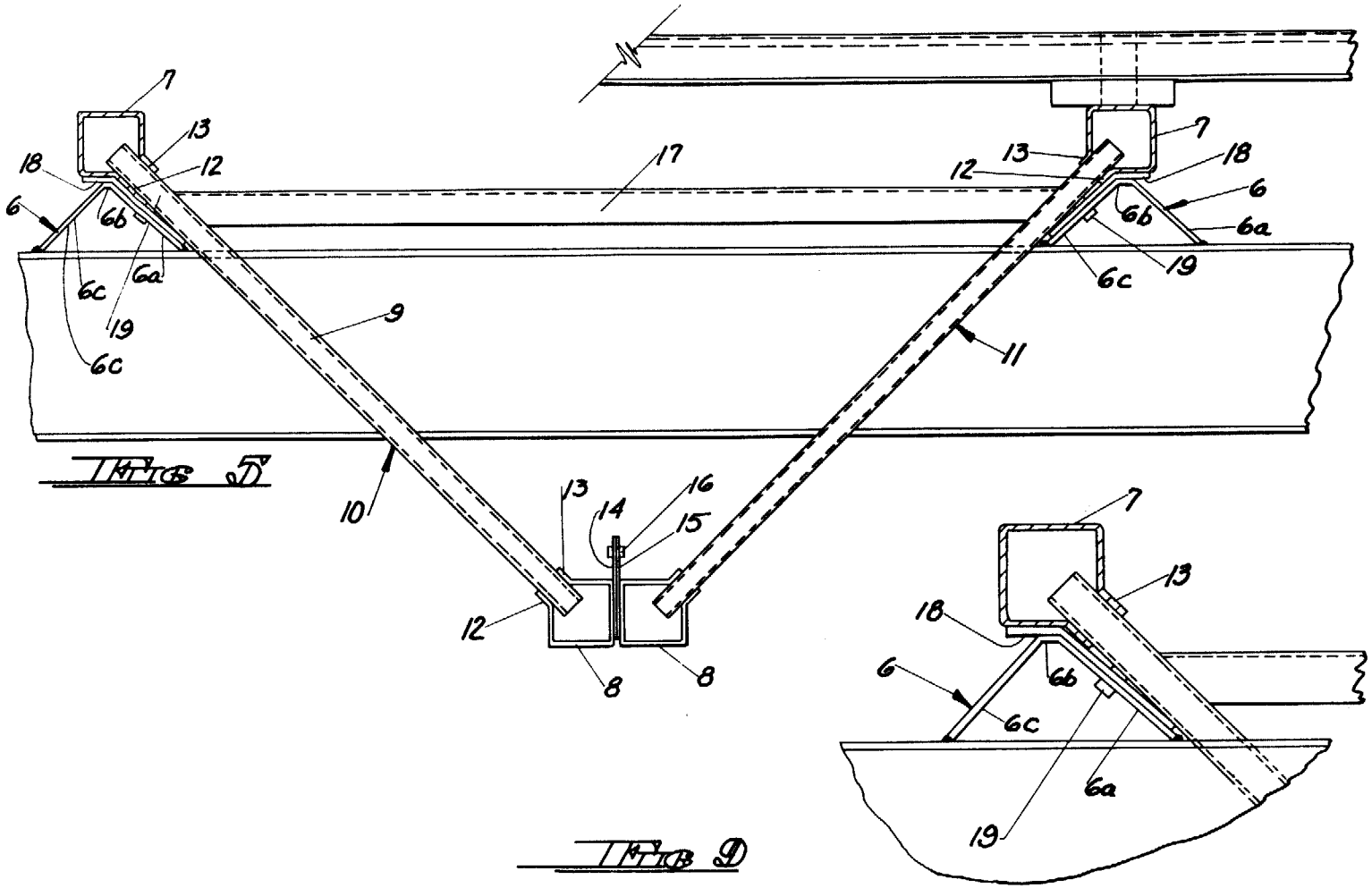
FIG. 5 is an enlarged end elevational view of a V-truss unit and its supporting seats.
FIG. 8 is a fragmentary elevational view of a V-truss unit illustrating the mounting bracket by means of which the unit is mounted to a supporting seat.

At the job site, two of the half-truss sections may be placed in a suitable support jig which will angularly dispose a pair of the half-truss sections 10 and 11 at an angle of approximately 90° to each other with their bottom chords juxtaposed in the manner seen in FIG. 5. By reason of the square configuration of the chords and their diagonal disposition relative to the web members 9, the abutting vertical disposed sides of the bottom chords 8 will lie in face-to-face relation and may be readily joined together, as by means of the tie plates 14 and 15 joined together by a series of bolts 16. The tie plates may be continuous throughout the length of the bottom chords, or they may be provided at spaced apart intervals. Alternatively, the bottom chords may be rigidly joined together by welding, or strap or clamp-like fasteners may be utilized in place of the tie plates.

When the truss sections 10 and 11 are angularly disposed relative to each other, their top chords will be tied together at spaced apart intervals by tie members 17 which also may be formed of tubular stock or open sections. The tie members 17 may be provided at their opposite ends with flanges or tongues adapted to be bolted to the diagonal web members 9 a short distance below the top chords 7. Alternatively, the tie members may extend directly between the top chords 7, although it is preferred to displace the tie members downwardly relative to the top chords to facilitate the installation of thermal insulation between the tie members and the overlying roof deck.

The top chords 7 of the V-trusses 3 are provided at their opposite ends with bearing plates 18 (also seen in FIGS. 8 and 9) by means of which the trusses are secured to the seats 6, the bearing plates being adapted to seat against the inclined surfaces of the seat 6, the seat having a first inclined surface 6*a*, intermediate upper surface 6*b*, and an opposing inclined surface 6*c*. The bearing plates 18 are welded to the half-truss sections, preferably during shop fabrication. It is preferred to weld the bearing plates to both the webs 9 and chord 7, although they may be welded to only one of these members. A structural advantage results where the bearing plates are welded to the webs 9 in that the forces are transferred directly to the seats, whereas if the bearing plates are only welded to the chord, the forces transfer to the seats via the chords and the strength of the welds becomes more critical. The opposing inclined surfaces 6*a* and 6*c* of the seats permit the V-truss units 3 to be seated on either side of the seat and consequently readily accommodate the truss units in the desired alternating relationship. The configuration of the seats also permits the mounting of the modified V-truss units 4 which lie in inclined relation to the truss units 3. The seats 6 are welded to the upper surfaces of the beams 2, preferably during shop fabrication of the beams. Bolts 19 are utilized to anchor the bearing plates 18 to the seats 6.

With the construction just described, all of the on-site fabricating operations involve the use of bolts, as opposed to welding. It will be understood that while a preference is expressed for the shop fabrication of the half-truss sections 10 and 11 and their on-site assembly into complete V-truss units 3, the complete V-truss units could be shop fabricated and shipped to the job site as such. However, once the V-truss units are fabricated, they occupy substantially more space and cannot be shipped as economically as the essentially planar half-truss sections. It also will be understood that if the complete V-truss units are shop fabricated, a single bottom chord could be utilized in place of the two bottom chords illustrated; and it will be obvious that other chord configurations could be employed. However, for the reasons stated, the on-site fabrication of the V-truss units from half-truss sections is preferred due to the economies which can be realized.

Figures 6, 8:
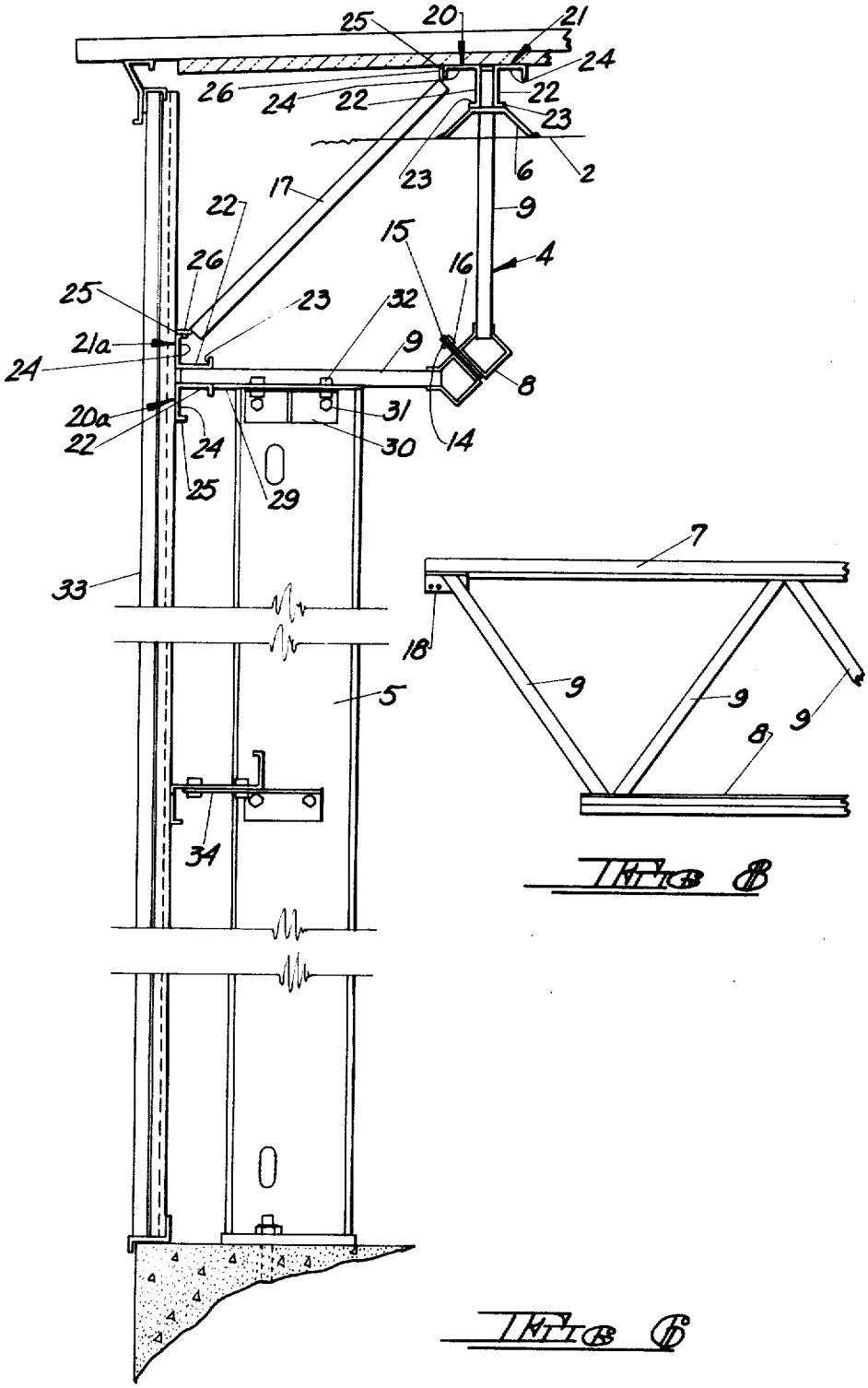
FIG. 6 is an enlarged elevational view of a modified and inclined V-truss unit taken along the line 6—6 of FIG. 2.

Referring next to FIG. 6, the modified truss units 4 have the same basic geometry as the truss units 3, including the configuration of the bottom chords 8 and the diagonal web members 9. However, since the V-truss units 4 are inclined relative to the roof supporting V-truss units 3, the top or outer chords are modified so that one of them (the uppermost chord) will have horizontally disposed surfaces which will coincide with the upper surfaces of the chords 7 of the V-truss units 3, the remaining chord (the outermost chord) defining vertically disposed surfaces which, as will be pointed out hereinafter, form vertical surfaces for supporting the wall panels of the structure. To provide the desired angularity, the uppermost and outermost chords of the modified V-truss units 4 each has a pair of chord members 20, 21 and 20*a*, 21*a*, respectively, arranged in back-to-back relation with the ends of the diagonal web members 9 sandwiched between and secured to the opposed surfaces 22 of the members 20, 21 and 20*a*, 21*a*. Each of the surfaces 22 terminates in an inturned lip 23, each chord member also has a surface 24 lying at right angles to the surface 22, each of the surfaces 24 terminating in an inturned lip 25. With this arrangement, the tie members 17 which interconnect the pairs of uppermost chord members 20, 21 and outermost chord members 20*a*, 21*a* may be provided at their opposite ends with tongues 26 adapted to be bolted or otherwise secured to the lips 25 or to other segments of the chord members 20 and 21*a* lying to the insides of the web members 9. As in the case of the V-truss units 3, the modified V-truss units 4 are preferably shop fabricated in half-truss sections and assembled on the job site.

As seen in FIG. 7, the uppermost chord members 20, 21 of the modified V-truss units 4 will be provided at their opposite ends with bearing plates 27 which are similar to the bearing plates 18 seen in FIG. 8, the bearing plates 27 serving to mount the modified V-truss units 4 on the opposite inclined surfaces of the seats 6 by means of bolts 28.

As previously noted, the inclined V-truss units 4 may be secured intermediate their ends to the wind support columns 5. As seen in FIG. 6, a bearing plate 29 is welded to the undersurfaces of the diagonal web members 9 in an area overlying the column 5, the column 5 being provided with angle brackets 30 adapted to have their vertical legs secured to the column, as by bolts 31, and their horizontal legs bolted to the bearing plate 29 as by bolts 32. The inclined V-truss units 4 are supported at their ends on the seats 6 and intermediate their ends they may support the columns 5, thereby effectively transmit shear forces to the columns 1 and 5 defining the sides of the building. Normally the columns will be attached to diagonal rods to transfer forces to the foundation. Thus, a wind load W, as shown in FIG. 1, is transferred through the chords 7 of V-trusses 3A' and 3B and through chords 20, 21 of the modified V-truss 4B. The wind load is then transferred from the plane of the top chords 7 and 20, 21 of the vertically disposed half-truss section of the modified V-truss 4 through its web members 9 into chord members 8 and then into the web members 9 of the horizontally disposed section of the modified V-truss 4. The load is then transferred from the horizontal section of the modified V-truss into conventional crossbraces extending diagonally between the columns 1 and 5 which carry the load to the foundation of the structure. The vertically disposed half-truss section of the modified V-trusses thus provide the mechanism for transferring horizontal loads vertically downward. As also will be evident from FIG. 6, the vertically disposed surfaces 24 of the outermost chord forming members 20*a*, 21*a* serve as supports or girts for the metal side wall panel 33 of the structure, additional support being provided by the girts 34 which may be affixed to the supporting columns 1 and 5.

Figure 4A:
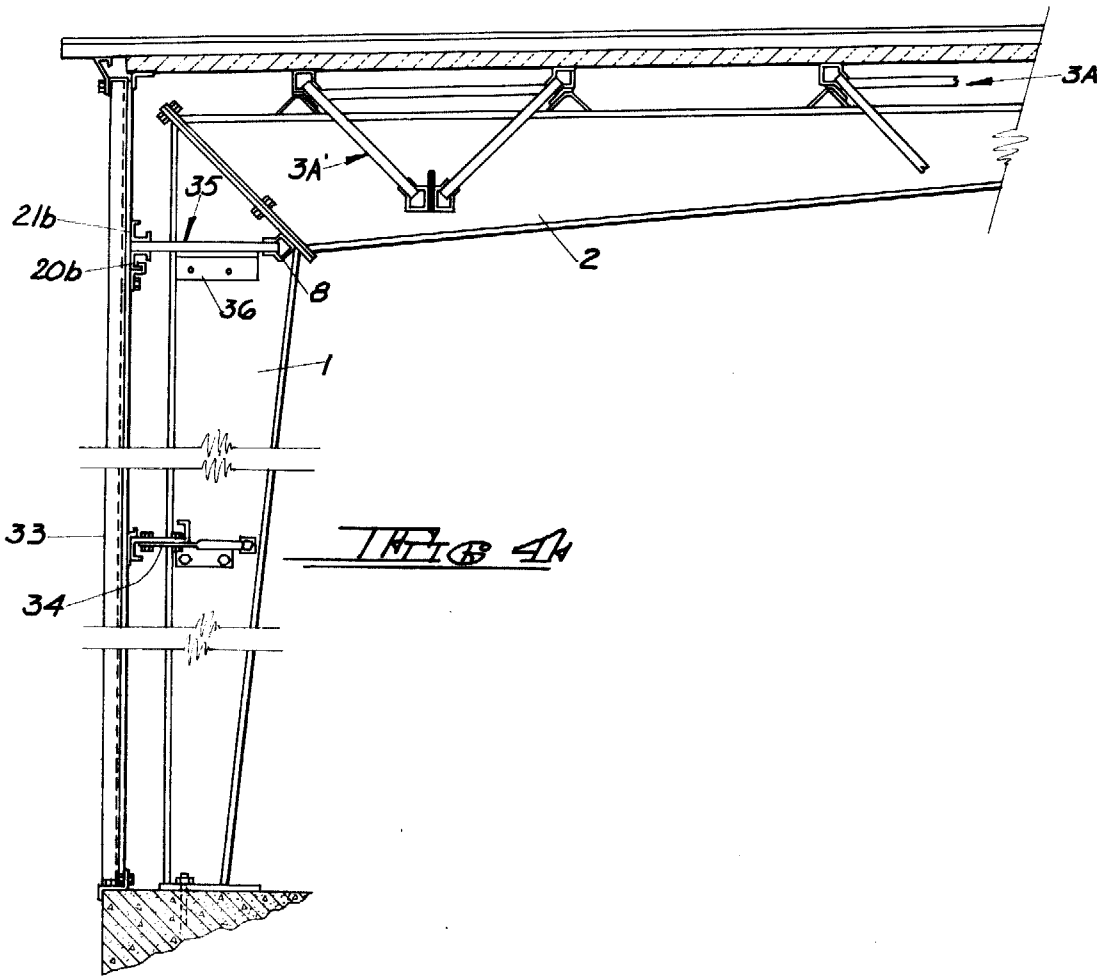
FIG. 4 is an enlarged elevational view of the load supporting roof structure taken along the lines 4—4 of FIG. 2.

In order to provide for continuity of support for the wall panels 33 in the rows between the inclined V-trusses 4, I-girts 35, seen in FIG. 1, extend between the beams 2 at the ends of the rows. As shown, I-girts 35 are provided at the ends of rows A and C. The I-girts may be essentially identical to the half-truss sections making up the modified V-trusses 4. As seen in FIG. 4, the I-girt 35 has a pair of chord members 20*b*, 21*b* arranged in back-to-back relation with the ends of the diagonal web members 9 sandwiched therebetween. At the opposite ends the web members 9 are secured to a chord member 8 to thereby form an essentially planar I-shaped member of a length to extend between the adjacent columns and beams of the structure. The I-girts 35 are horizontally disposed and in alignment with the horizontal disposed half-truss section of modified V-trusses 4, the vertically disposed surfaces of chord members 20*b* and 21*b* lying in axial alignment with the chord members 20*a* and 21*a* of the adjoining modified V-trusses 4, thereby providing continuity of support for the wall panels 33 throughout the length of the wall.

The I-girts 35 are secured at their opposite ends to the columns 1 by means of angle brackets 36 mounted on the columns 1, as shown in FIG. 4. Wind columns similar to the columns 5 may be provided intermediate the ends of the I-girts 35, but normally are not required unless the height of the side walls exceeds the spanning capacity of the wall panels. While a preference is expressed for I-girts having the same configuration as the half-truss sections of the modified V-trusses, other configurations may be employed consistent with the objective of providing the necessary support for the wall panels 33.

Figure 10:
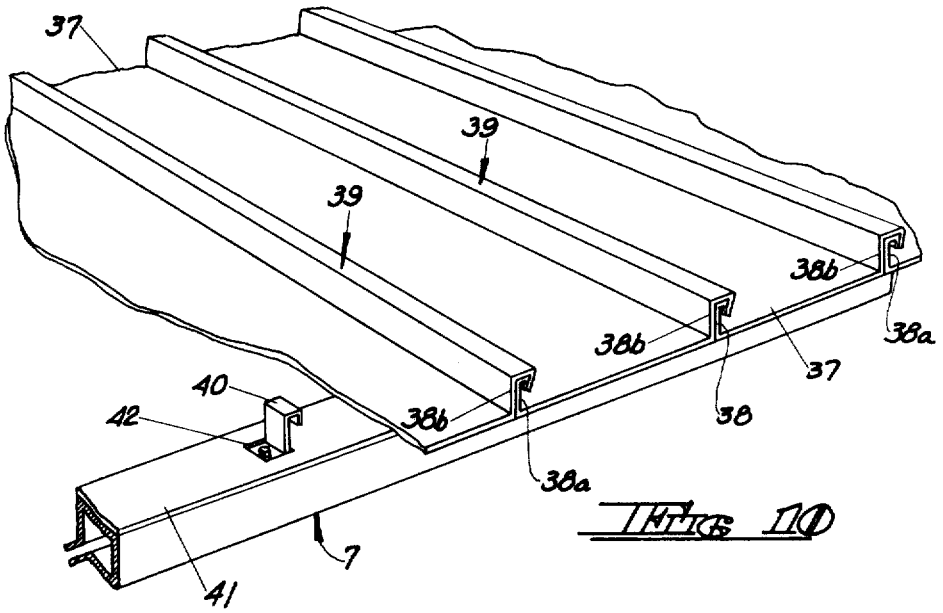
FIG. 10 is a fragmentary perspective view of a roof covering incorporating rib forming joints and hidden fasteners.

Following installation of the V-truss units, the roof covering will be applied over the top chords 7 of the V-trusses 3 and the adjoining uppermost chord members 20, 21 of the inclined V-truss units 4. As seen in FIG. 10, a preferred roof construction comprises a series of relatively stiff and rigid interlocking metal panels 37 provided along their opposite edges with inverted channel-shaped ribs 38*a* and 38*b* adapted to be interlocked to form tight joints 39 between adjoining panels. The joint forming ribs 38*a* and 38*b* extend at right angles to the top chords of the V-trusses, such as the chords 7, and are secured to the upper surfaces of the V-trusses by concealed fasteners 40 mounted on the top chords. The roof panels 37 are preferably seated on insulation strips 41 applied to the upper surfaces of the top chords, the insulation strips preferably being formed from a low heat conductive non-metallic material provided with apertures 42 for receiving the fasteners 40.

Figure 11:
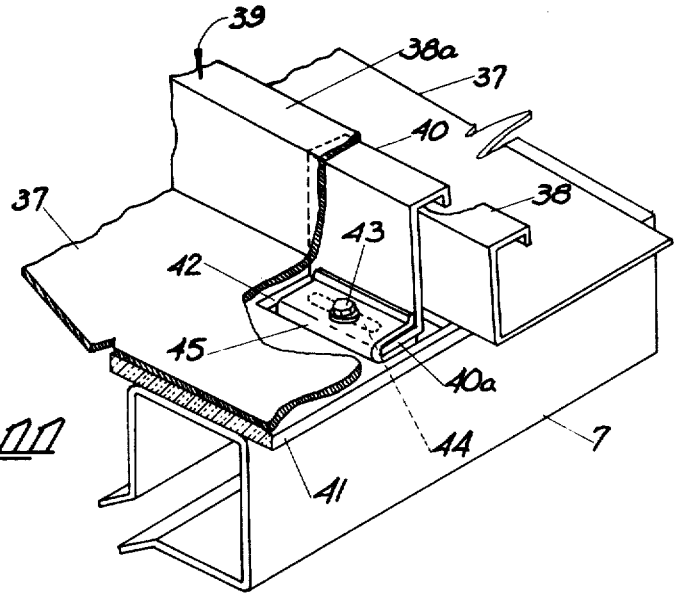
FIG. 11 is an enlarged fragmentary perspective view illustrating the manner in which the roof covering and hidden fasteners are mounted on the V-truss units.

As will be apparent from FIG. 11, the channel-shaped ribs 38*a* are adapted to be received within the ribs 38*b*, with the concealed fasteners 40 sandwiched therebetween. The integrity of the joint is maintained by crimping the free edges of the ribs inwardly once the panels have been assembled. The fasteners 40 may be attached to the chords by means of self-drilling screws 43, the foot 40*a* of the fastener 40 being provided with an elongated slot 44 extending lengthwise thereof, the foot being engaged between the opposite sides of a U-shaped washer 45 having aligned apertures therein through which the screw 43 passes. With this arrangement, the fasteners may move relative to the top chords to allow for shifting of the roof panels due to thermal expansion or contraction. Reference is made to U.S. Pat. No. 4,102,105 for details of the construction and assembly of interlocking roof panels and hidden fasteners. While a hidden fastener roof system is preferred, the roofing panels may be of any conventional design utilized in the metal building industry, and various types of fasteners may be employed to fasten the roofing panels to the top chords, such as self-drilling through-fasteners.

As should now be apparent, the present invention provides an integrated roofing system in which V-truss units are arranged in alternating relation to provide effective support for incidental forces acting on the roof structure, including shear forces of the type developed by wind or seismic load. By eliminating the necessity for lateral bracing between adjacent V-truss units, the cost of the system is materially reduced and yet it has outstanding strength characteristics, including the ability to transfer lateral loads from the roof to the walls of the structure. The design of the structure is such that it may be readily prefabricated for assembly at the job site, the assembly of the V-truss units as well their erection and attachment to the rafters being accomplished without the necessity for welding on the job site. Of course, if desired, the parts may be welded on the job site during erection but such expedient is not necessary.

What is claimed is:

1. A roof supporting structure comprising a series of spaced apart rafters lying in parallel relation, a series of elongated V-truss units extending between the rafters in parallel relation at spaced apart intervals to define rows of V-truss units, said elongated V-truss units each comprising a spaced apart pair of top chords and at least one bottom chord defining the apex of the V-truss unit, and diagonally disposed web members interconnecting said top and bottom chords, said top chords being supported at their opposite ends on said rafters, the V-truss units in at least one given row lying in alternating relation with respect to the V-truss units in the next adjacent row, and means interconnecting the ends of the top chords of the V-truss units in one row with the adjoining ends of the top chords of the V-truss units in the next adjacent row.

2. The roof supporting structure claimed in claim 1 wherein the means interconnecting the ends of said V-truss units comprise seats mounted on said rafters to which the ends of said top chords are secured.

3. The roof supporting structure claimed in claim 2 wherein said seats have opposed inclined sides to which the ends of the top chord members are secured.

4. The roof supporting structure claimed in claim 3 wherein bearing plates are mounted on the ends of said V-truss units, said V-truss units being secured to the inclined sides of said seats by means of said bearing plates.

5. The roof supporting structure claimed in claim 3 wherein the V-truss units in adjacent rows are seated on common seats, and wherein the top right-hand chords of the V-truss units in a given row are aligned with the top left-hand chords of the V-truss units in the next adjacent row.

6. The roof supporting structure claimed in claim 1 wherein modified V-truss units extend between the outermost ends of the rafters in alternate rows of the V-truss units, the modified V-truss units lying in the rows between the rows containing the V-truss units lying closest to the outermost ends of said rafters.

7. The roof supporting structure claimed in claim 6 wherein said modified V-truss units have uppermost chord members adapted to be interconnected with the adjoining top chords of the outermost V-truss units in the rows adjacent the rows containing the modified V-truss units.

8. The roof supporting structure claimed in claim 7 wherein said rafters are supported at their outermost ends on columns, wherein said modified V-truss units support columns positioned intermediate said rafter supporting columns, and wherein means are provided for securing said intermediate columns to said modified V-truss units.

9. The roof supporting structure claimed in claim 8 wherein said modified V-truss units have outermost chord members defining vertical surfaces adapted to support wall panels of a building utilizing said roof supporting structure.

10. The roof supporting structure claimed in claim 9 including girt members extending between the outermost ends of the rafters in the rows containing the V-truss units lying closest to the outermost ends of said rafters, said girt members having surfaces positioned to support the wall panels of the building.

11. The roof supporting structure claimed in claim 10 including a roof comprising a series of panels seated on and secured to the top chords of said V-truss units.

12. The roof supporting structure claimed in claim 11 including wall panels secured to the outermost chord members of said modified V-truss units, to said columns, and to said girt members.

13. The roof supporting structure claimed in claim 11 wherein said V-truss units each comprises a pair of half-truss sections each having a top chord and a bottom chord interconnected by web members, said half-truss sections being angularly disposed with respect to each other with their bottom chords juxtaposed and secured together and with their top chords spaced apart and interconnected by tie members.

14. The roof supporting structure claimed in claim 13 wherein said top and bottom chord members each comprises an elongated hollow member which is essentially square in cross-section and has a slot extending lengthwise along one corner edge thereof in which said web members are secured.

15. The roof supporting structure claimed in claim 14 wherein modified V-truss units extend between the outermost ends of the rafters in alternate rows of the V-truss units, the modified V-truss units each comprising a pair of half-truss sections having an outer chord and an inner bottom chord interconnected by web members, said half-truss sections being angularly disposed with respect to each other with their inner chords juxtaposed and secured together and with their outer chords spaced apart and interconnected by tie members.

16. The roof supporting structure claimed in claim 15 wherein the ends of one of the outer chords of each modified V-truss unit is connected to the ends of the top chords of the V-truss units in the rows adajacent to the rows containing said modifying V-truss units, and wherein the second of said outer chords of each modified V-truss unit and the inner chords thereof lie in a common horizontal plane with said second outer chord extending outwardly to provide support for wall panels of a building incorporating said roof supporting structure.

17. The roof supporting structure claimed in claim 16 wherein the outer chords of said modified V-truss units each comprises a pair of chord members arranged in back-to-back relation with the ends of the web members sandwiched therebetween, each said chord member having a vertically disposed surface and a horizontally disposed surface.

18. The roof supporting structure claimed in claim 17 including girt members at the ends of the rows adjacent the rows containing said modified V-truss units, said girt members having surfaces positioned to support the walls of a building incorporating said roof supporting structure.

19. A method of erecting a series of V-truss units to form a roofing structure having enhanced horizontal load resisting capability, which comprises the steps of providing a series of spaced apart rafters lying in parallel relation to each other to define rows therebetween, and a series of elongated V-truss units each having a bottom chord and a pair of spaced apart top chords, the top chords being of a length to bridge the distance between the rafters defining adjacent rows, positioning the V-truss units on the rafters with the V-truss units in at least two adjacent rows spaced from each other by a distance substantially equal to the width of the V-truss units measured at their top chords, and with the V-truss units in a first row lying in alternating relation with respect to the V-truss units in the next adjacent row, and interconnecting the ends of the top chords of the V-truss units in said first row with the adjoining ends of the top chords of the V-truss units in the next adjacent row, whereby horizontal forces will be transmitted laterally between the V-truss units in adjoining rows.

20. The method claimed in claim 19 including the step of providing seat means on the rafters, and securing the ends of the top chords to said seat means, the V-truss units in adjacent rows being interconnected through said seat means.

21. The method claimed in claim 20 including the step of providing bearing plates at the ends of said top chords, and securing said bearing plates to said seat means to thereby secure said top chords to said seat means.

22. The method claimed in claim 21 including the step of providing additional V-truss units each having a bottom chord and a pair of spaced apart outer chords at least one of which is of a length to bridge the distance between the rafters defining adjacent rows, positioning the additional V-truss units between the outermost ends of the rafters in alternate rows which lie between the rows containing the V-truss units lying closest to the outermost ends of the rafters, and interconnecting the ends of the outer chords bridging the distance between adjacent rafters with the ends of the top chords of the outermost V-truss units in the rows adjacent the rows containing the additional V-truss units.

23. The method claimed in claim 22 including the step of providing a series of columns, positioning some of the columns to support the rafters at their opposite ends, and positioning others of said columns to engage said additional V-truss units intermediate their ends.

24. The method claimed in claim 23 including the step of positioning said additional V-truss units so that one of the outer chord members projects outwardly to define a support for the wall panels of a building utilizing said roof structure.

25. The method claimed in claim 24 including the step of providing elongated girt members of a length to span the distance between adjacent rafter supporting columns, and connecting the ends of the girt members to the outermost rafter supporting columns in the rows adjacent the rows containing said additional V-truss units.

26. The method claimed in claim 20 including the step of providing roof panels and wall panels, securing the roof panels to the top chords of said V-truss units, and securing the wall panels to the outwardly projecting chords of the additional V-truss units and to the intermediate columns engaging the additional V-truss units.

* * * * *